United States Patent [19]

Lowe et al.

[11] Patent Number: 5,052,685

[45] Date of Patent: Oct. 1, 1991

[54] SOUND PROCESSOR FOR VIDEO GAME

[75] Inventors: Danny D. Lowe; John W. Lees, both of Calgary, Canada

[73] Assignee: QSound Ltd., Calgary, Canada

[21] Appl. No.: 447,422

[22] Filed: Dec. 7, 1989

[51] Int. Cl.[5] ..... A63F 9/22

[52] U.S. Cl. ..... 273/460; 273/85 G; 273/DIG. 28; 381/17

[58] Field of Search ..... 273/1 E, 856, 148 B, 273/DIG. 28; 358/341; 381/1, 17, 63; 364/410

[56] References Cited

U.S. PATENT DOCUMENTS

| | | | |
|---|---|---|---|
| 3,670,106 | 6/1972 | Orban | 381/17 |
| 4,305,131 | 12/1981 | Best | 273/DIG. 28 |
| 4,574,391 | 3/1986 | Morishima | 273/85 G |
| 4,611,226 | 10/1986 | Buhse et al. | 381/17 |
| 4,648,115 | 3/1987 | Sakashita | 381/17 |
| 4,706,287 | 11/1987 | Blackmer et al. | 381/63 |
| 4,792,974 | 12/1988 | Chace | 381/17 |
| 4,812,921 | 3/1989 | Mitsuhashi et al. | 381/17 |
| 4,841,572 | 6/1989 | Klayman | 381/17 |

*Primary Examiner*—Edward M. Coven
*Assistant Examiner*—Jessica Harrison
*Attorney, Agent, or Firm*—Lewis H. Eslinger; Jay H. Maioli

[57] ABSTRACT

The game software for a video game system includes audio data and sound positioning information, in order that the audio data can be processed in accordance with the sound positioning information and played back over two spaced-apart speakers to give the player the impression that the sound is emanating from a location other than the actual speaker locations. A sound processor operates upon monaural signals from an audio synthesizer in response to the sound positioning information from the game software so that each monaural signal from the audio synthesizer is divided into two signals and at least one of the signals is passed through a transfer function to produce two-channel output signals that have a differential phase and amplitude relationship therebetween that is adjusted on a frequency dependent basis. Each different sound location generally requires a specific different relationship, and the sound processor for the video game may include a number of different transfer functions, each of which can be embodied by adjusting a digital filter in response to the sound positioning information. Each digital filter alters the amplitude and phase of the applied signal in a frequency dependent manner over the audio frequency spectrum.

17 Claims, 4 Drawing Sheets

SOUND PROCESSOR FOR VIDEO GAME

BACKGROUND OF THE INVENTION

1. Field of the Invention

This invention relates generally to a sound system for a video game and, more particularly, to the construction of a sound processor that permits use of sound location information provided in the game software to place the sound image at a desired location.

2. Description of the Background

Interactive video games have now become so well known that everyone has either played such games or has seen others play them. These interactive games provide the player with some sort of control, such as a joy stick and/or actuating buttons to control the video display and progress of the game. Audio program material is also associated with the video display but to date the audio program material has been much less sophisticated than the corresponding video program material. More recently, however, some video game sound programs have been provided in stereo.

Typically, the sound program material is replayed over the speaker contained in the television receiver or monitor. In arcade video games speakers are generally contained within the module housing the arcade game. Some video game systems can also be connected directly to the amplifier and speakers of the home stereo system.

Even though some improvement has been made in the audio program material for video games, such program material is still far below the level of sophistication of the video program material and, thus, generally the games have not been improved as much as they might have. There have also been attempts to use surround sound equipment with video games, however, such surround sound equipment is very expensive and far outweighs the cost of the actual video game itself and, thus, has had little or no popularity.

OBJECTS AND SUMMARY OF THE INVENTION

Accordingly, it is an object of the present invention to provide a sound system for a video game that provides a sound program that is markedly improved over the sound programs of video games known heretofore.

Another object of this invention is to provide a sound processor for a video game system that operates upon the monaural outputs of the audio synthesizer of the video game in accordance with sound location information derived from the game software to give the game player the impression that the sound is emanating from a location other than the actual locations of the loudspeakers.

A further object of the present invention is to provide a sound processor for a video game that includes transfer functions that operate upon the monaural signals from an audio synthesizer to provide respective two-channel signals having differential phase and amplitude adjusted on a frequency dependent basis for playback over two spaced-apart transducers.

A still further object of the present invention is to provide a sound processor for a video game employing sound location information derived from the game software that includes a number of filters and gain adjusters that can accomplish the transformation of each monaural audio signal from the audio synthesizer into respective two-channel signals having differential phase and amplitude relationship that is adjusted on a frequency dependent basis.

According to an aspect of the present invention, sound location information and the appropriate audio cues for the audio synthesizer are prerecorded or programmed into the video game cartridge at the time of its manufacture. Thereafter, upon playing the game, the audio cue information is utilized by the audio synthesizer to produce monaural signals representing the appropriate sounds. Such signals and the sound location information derived from the game program are fed to a sound processor that processes the monaural synthesized sound utilizing one or more specially derived sound processing transfer functions to produce two-channel sound information having a differential phase and amplitude relationship adjusted on a frequency dependent basis that is then fed to two spaced-apart transducers, which may be either in the existing television receiver/monitor or separate speakers or earphones, so that the sounds heard by the game player appear to be emanating from a point other than the actual locations of the speakers. By specially arranging gain attenuators and filters, a number of transfer functions are achievable, which transfer functions have different respective sound locations.

The above and other objects, features, and advantages of the present invention will become apparent from the following detailed description of illustrative embodiments thereof to be read in conjunction with the accompanying drawings, in which like reference numerals represent the same or similar elements.

DETAILED DESCRIPTION OF PREFERRED EMBODIMENTS

In U.S. patent application Ser. No. 239,981, filed Sept. 2, 1988 and assigned to the assignee hereof, a sound imaging process is disclosed, whereby upon utilizing appropriate transfer functions to process a monaural audio signal, two-channel sound signals are produced that have their differential phase and amplitude adjusted on a frequency dependent basis. The phase and amplitude adjustments are individually made for successive frequency bands over the audio spectrum. Utilization of this transfer function to produce the differential two-channel audio signal results in sounds being produced that are apparently located at a position other than the location of the two loudspeakers or transducers. The disclosure of the above-identified patent application is incorporated herein by reference.

Figure 1:
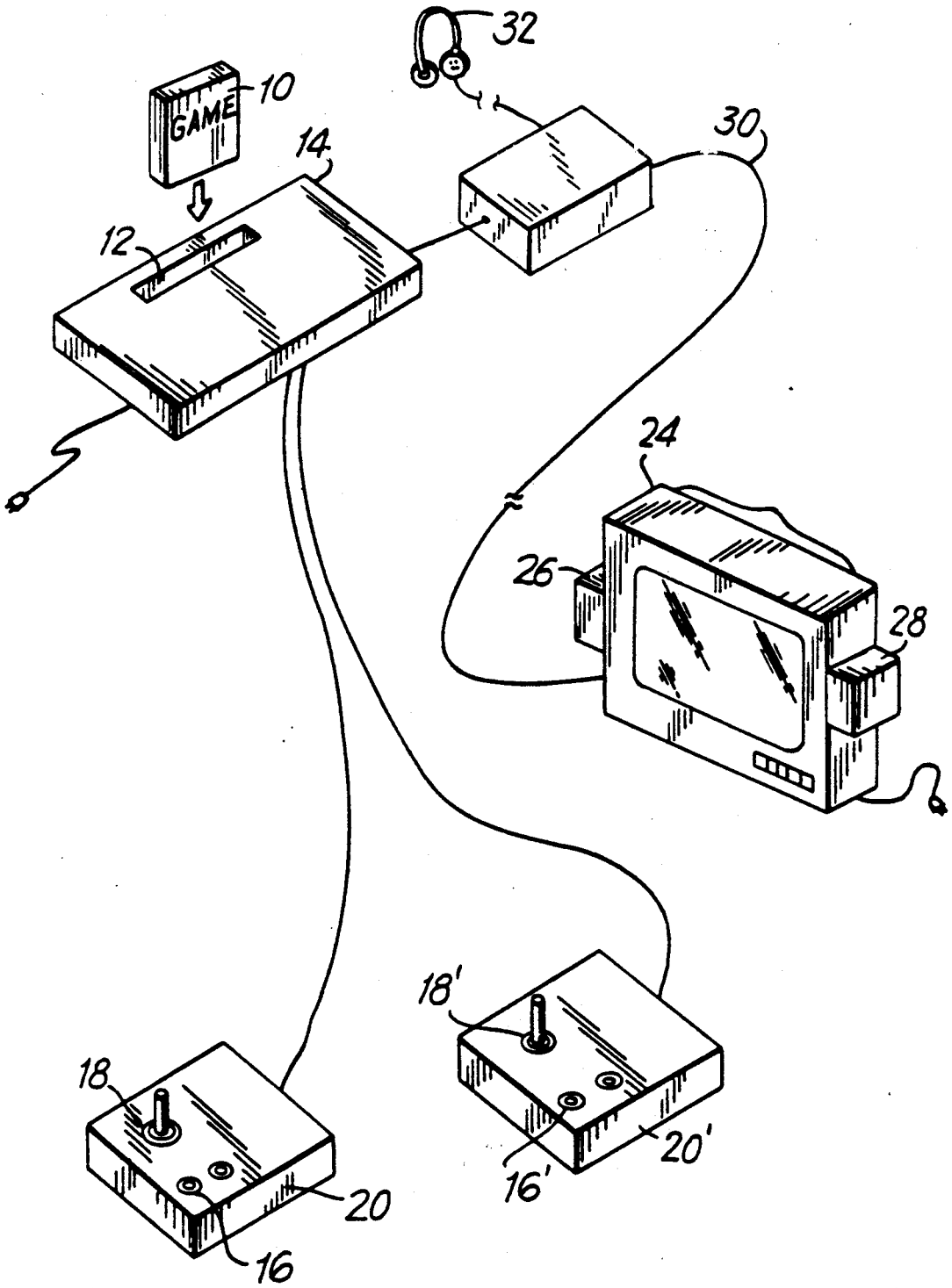
FIG. 1 is a pictorial representation of a video game system to which the inventive sound processor has been added.

Represented in FIG. 1 is a typical video game system having a sound processor according to the present invention added thereto. More specifically, a game cartridge 10 is of the common configuration and is generally adapted to be inserted into a slot 12 formed in a video game base unit 14. In order to utilize the present invention, however, the game cartridge 10 includes sound location information that is used to process monaural audio signals according to the principles of the above-identified patent application. Cartridge 10 also includes the typical sound program material in the form of cues for the audio synthesizer (not shown) that is typically included as part of a video game. Also part of the video game system is the control unit 20 that includes buttons, shown typically at 16, and a joystick 18 located on the player control unit 20. The player control unit 20 then permits the game player to control the action of the game as it progresses. There are occasions where two remote control units are provided and generally such units are identical. A second such control unit is shown in FIG. 1 at 20' having buttons 16' and joystick 18'.

As explained in the above-identified patent application incorporated herein by reference, the sound processing system can employ suitable transfer functions and receives monaural audio signals and produces respective two-channel signals therefrom, each having a differential phase and amplitude relationship adjusted on a frequency dependent basis over the entire audio spectrum. The sound processing system then sums all of the respective two-channel signals to form two-channel output signals. These two-channel output signals produced from the original monaural signals are then played back over two spaced-apart transducers, which may be the speakers of a television set or which may be earphones or other external speakers. The results of this signal processing is that the sound appears to emanate from a point that is not the same as the location of either of the two transducers. For example, assuming one were facing two speakers directed generally outwardly and the center point between the speakers is considered to be twelve o'clock on a clock face, then it is possible to make the sound appear to the listener to be emanating from a point at 3 o'clock or 9 o'clock, for example, or, indeed, 6 o'clock. Furthermore, the elevation of the sound source can be adjusted as well.

Thus, in the embodiment of FIG. 1, game cartridge 10 contains sound positioning information that might relate to various kinds of sound information typically included in such game cartridges. For example, a game cartridge may provide stationary sounds relating to the background environment of the game, or it may include dynamic sounds relating to the particular picture being provided on the video monitor or it may include dynamic sounds that are created by the actions of the game player utilizing buttons 16 and joystick 18, for example.

Accordingly, this information is fed from the cartridge 10 to the audio synthesizer unit (not shown) that is located in the outboard sound processor unit 24 over multi-line cable 22. As well, the sound location information contained in game cartridge 10, is fed on a multi-line cable 22 to outboard sound processor 24 that is constructed according to an embodiment of the present invention and that will be described in detail hereinbelow. In sound processor 24, each monaural audio signal produced by the audio synthesizer is converted into two-channel sound signals in response to respective sound location information derived from the game cartridge 10. It will be appreciated that not all of the monaural audio signals produced by the audio synthesizer in accordance with the information from game cartridge 10 will undergo processing by sound processor 24 and, thus, certain sounds will appear to be emanating from the location of the actual loudspeakers 26, 28 during the time that the sound location information does not apply.

In place of loudspeakers 26, 28 the sound signals can also be reproduced over earphones 32 and, using such earphones, the sound location image can also be positioned as described above in the same fashion as if the sounds were being reproduced over loudspeakers 26, 28.

To specify the connection of sound processor 24 in the existing video game system, the video information from base unit 14 can also be fed out on cable 22 directly through sound processor 24 and fed to monitor 30 on cable 34, along with the processed two-channel audio signals.

Figure 2:
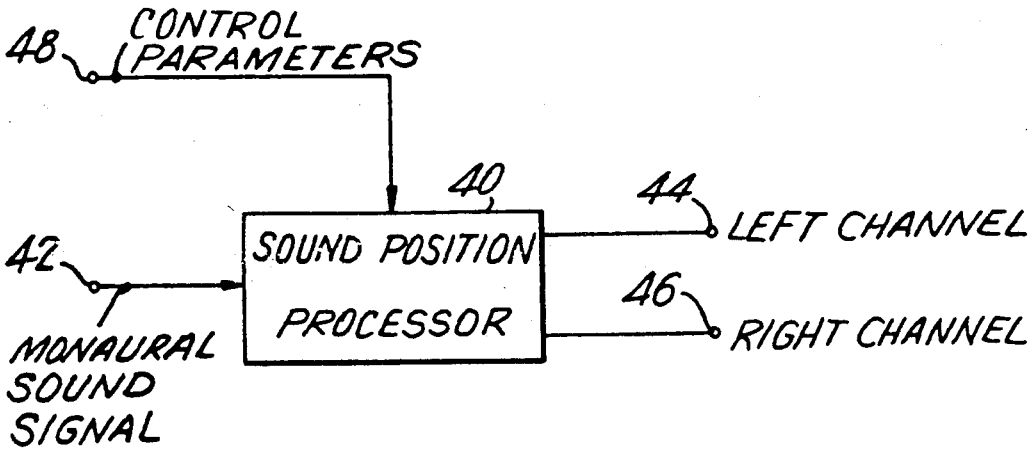
FIG. 2 is a block diagram showing the flow of information in the sound processor of FIG. 1 in accordance with an embodiment of the present invention.

In order to produce the two-channel signals with differential phase and amplitude adjusted on a frequency dependent basis, the present invention provides a sound position processor 40, shown generally in FIG. 2. Sound position processor 40 operates on the monaural sound signal, such as might be provided by an audio synthesizer, at input terminal 42 to produce left and right output signals at output terminals 44, 46. While the signals at output terminals 44, 46 may be thought of as corresponding to the left and right channels of a conventional stereo system, the sound image ultimately produced by the loudspeakers in accordance with the present invention does not correspond to conventional stereo. Each different position or location of an apparent sound source is controlled by applying a respective transfer function to provide a phase and amplitude differential between the left and right output signals, and this transfer function is then controlled by means of a control signal applied at input terminal 48. The information for generating this control signal is contained within game cartridge 10 and is fed through the microprocessor (not shown) typically employed in all video games. As will be explained hereinafter, the implementation of this sound positioning processor may be either digital or analog and may include some or all of the following functional circuit elements: filters, delays, inverters, summers, amplifiers, and phase shifters. The control information fed in at terminal 48 can be used to alter the parameters of the above functional circuit elements to obtain the specific transfer function required to produce the desired sound image location.

Figure 3:
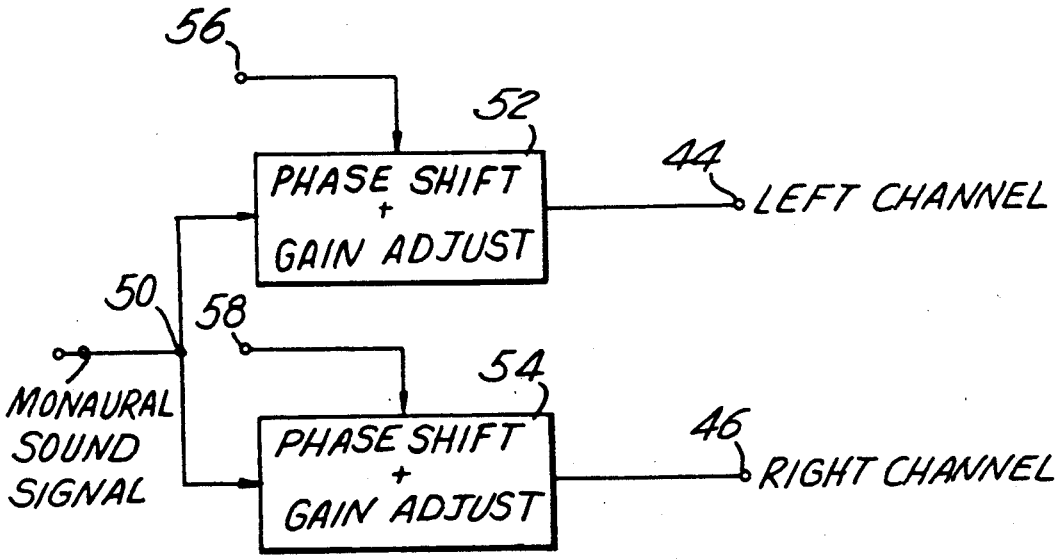
FIG. 3 is a block diagram showing the sound processor of FIG. 2 in more detail.

FIG. 3 represents an ideal implementation of the sound position processor 40 of FIG. 2, in which a separate filter is provided in each of the two channels, with the phase and amplitude adjustment taking place in each channel to produce the desired phase and amplitude differential on a frequency dependent basis at the two output terminals 44 and 46. Nevertheless, it is understood that it is the differential feature that is the most important and that therefore only one channel need be adjusted in amplitude and phase with the other channel being fed unchanged directly to the output. The required two channels are provided by dividing or splitting the input signal, and this is simply represented at the junction point 50 in FIG. 3. Identical signals are then fed to a filter 52 in the left channel and to a filter 54 in the right channel. The various new positions of the sound image are then controlled by varying the filter parameters in accordance with control parameter information at input 56 to filter 52 and at input 58 to filter 54. This control parameter information is derived from the game cartridge 10. For example, in a digital implementation filters 52, 54 can be finite impulse response filters whose coefficients are varied to provide different effective transfer functions.

As pointed out above, each channel need not have the transfer function implementation in it, provided that the required differential is present between the output signals of the produced two channels.

Figure 4:
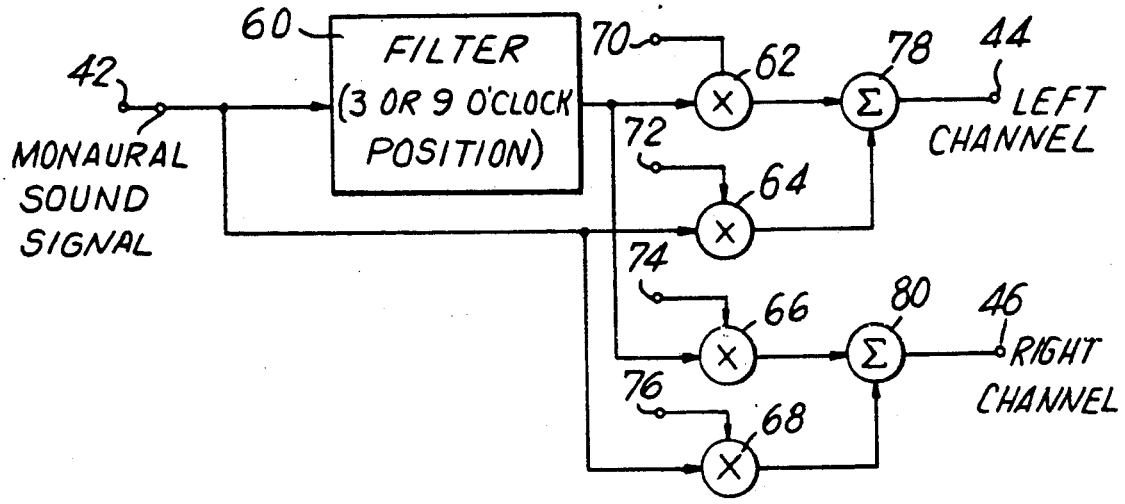
FIG. 4 is a block diagram showing another embodiment of a sound processor according to the present invention.

FIG. 4 represents an implementation where only a single filter 60 and four gain-adjusting circuits 62, 64, 66, and 68 produce a number of transfer functions sufficient to provide a sound image at a left position, a right position, and all intermediate positions. Specifically, filter 60 is a so-called 3 o'clock and 9 o'clock transfer function, that is, it produces a 3 o'clock or 9 o'clock position in the sound location and then the four gain-adjusting circuits 62, 64, 66, 68 are controlled to provide intermediate positions in response to control parameters from the game cartridge fed in at inputs 70, 72, 74, 76, respectively. In effect, the implementation of FIG. 4 mixes a full-left or full-right position variably with a direct signal, to provide intermediate positions and such mixing occurs in summers or mixer units 78 and 80.

As an operative example, where the sound is to be located in the full-left position, that is, at 9 o'clock, then the gain in gain adjuster 62 is set to zero by a signal at input 70, the gain in gain adjuster 64 is set to its maximum by a signal at input 72, the gain in gain adjuster 66 is set to its maximum by a signal at input 74, and the gain in gain adjuster 68 is set to zero by a signal at input 76. To move from the full-left position to approximately the position of the left loudspeaker or transducer, the gain in gain adjuster 66 is set to zero by a signal at input 74. To move from the left loudspeaker to the right loudspeaker, the gain in gain adjuster 64 is varied to zero by a signal at input 72 and the gain in gain adjuster 68 is set to its maximum by a signal at input 76. In other words, these gain adjuster settings would result in a what would be seen to be a standard stereo signal with both left and right channels being substantially equal. Then, to move from the right speaker to the full right position, that is, 3 o'clock, gain adjuster 62 would be varied to have a maximum gain by a signal at input 70.

Figure 5:
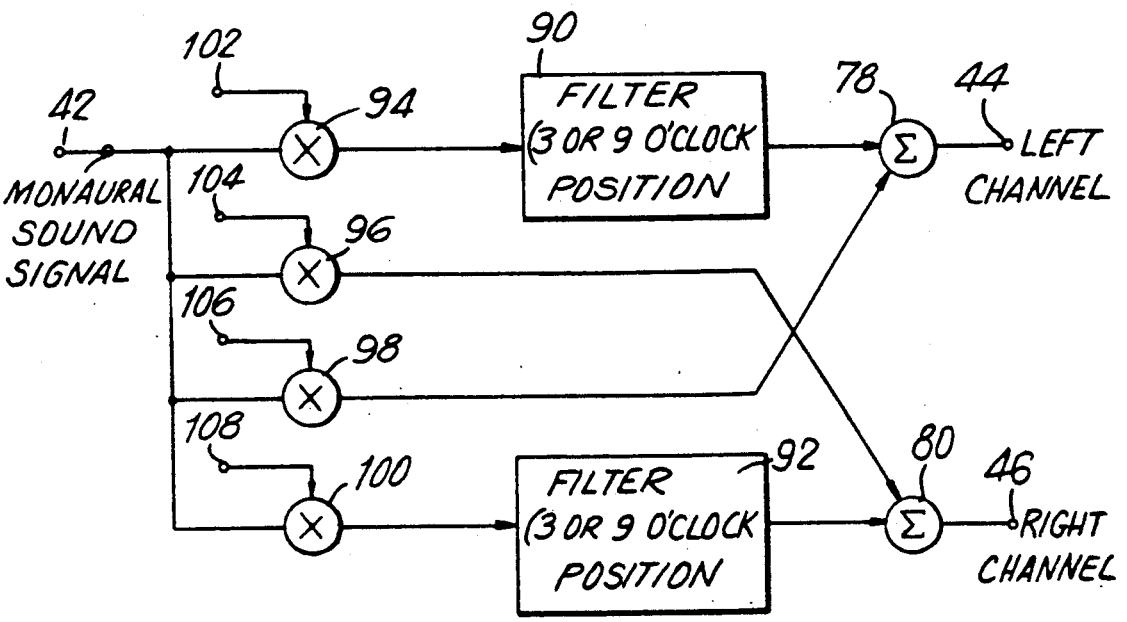
FIG. 5 is a block diagram showing a further embodiment of a sound processor according to the present invention.

An alternate implementation of the embodiment of FIG. 4 is shown in FIG. 5. The embodiment of FIG. 5 employs two 3/9 o'clock filters 90, 92 and employs two summers or adders 78, 80 as in FIG. 4. A gain adjuster 94 is provided at the input to filter 90 and the same monaural input signal at terminal 42 is fed through a second gain adjuster 96 directly to summer 80 without any adjustment. Similarly, the same input monaural signal is fed through gain adjuster 98 directly with no adjustment to summer 78. The input of second filter 92 is provided with a gain adjuster 100 and the output of second filter 92 is fed to adder 72 that also receives the output of summer 96. Once again, by adjusting the gains in gain adjusters 94, 96, 98, 100 in response to the control parameters from the game cartridge fed in on lines 102, 104, 106, 108, respectively, it is possible to mix the full-left or full-right positions variably with direct signals to provide intermediate positions between the full-left and full-right positions.

Figure 6:
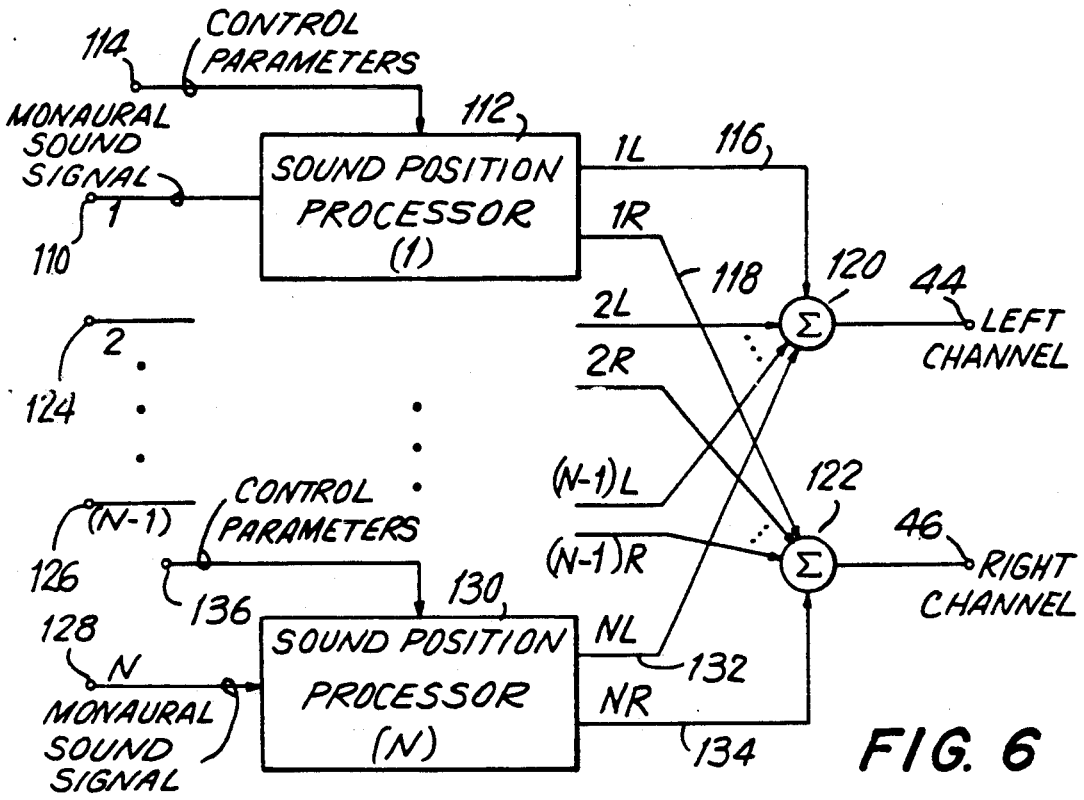
FIG. 6 is a block diagram showing a number of sound processors connected together according to an embodiment of the present invention.

According to the inventive sound position processor of the present invention, regardless of the number of monaural input signals that are available, the sound processor produces only two output signals therefrom. Each audio signal produced by an audio synthesizer can have its own processor according to the present invention so that certain signals can be positioned to various points. For example, as shown in FIG. 6, multi-input channels are organized to have each signal processed in accordance with its own individual control parameters and the multiple outputs are then summed to form the left and right channels. More specifically, a monaural sound signal from an audio synthesizer of a video game, for example, is fed in at input terminal 110 to a first sound position processor 112 that can be embodied as shown in FIGS. 2–5, for example. The sound position processor 112 also receives the positioning control parameters at input terminal 114 that determine whether or not and to what extent the monaural sound signal at input 110 will be relocated in relation to the loudspeakers. Sound position processor 112 produces a left-channel signal on line 116 and a right-channel signal on line 118, with the left-channel signal being fed to a first adder 120 and the right-channel signal being fed to a second adder 122. A sound position processor, each identical to sound position processor 112, is provided for each of the separate monaural input signals. For example, a second monaural signal is fed in at input terminal 124, input terminal 126 receives the (N-1) monaural input signal, and input terminal 128 receives the Nth monaural input signal that is produced either by the audio synthesizer or from some other sound source. As in the first channel, the monaural sound signal at input terminal 128, for example, is fed to a sound position processor 130 that produces a corresponding left-channel output on line 132 fed to adder 120 and a right-channel output on line 134 fed to adder 122. Once again, the positioning is controlled by a signal at input terminal 136 relating to the control parameters for the sound image location as derived from the game cartridge shown in FIG. 1. Each sound position processor that is arranged between the first sound position processor 112 and the last sound position processor 130 provides corresponding left and right output signals fed to adders 120 and 122, respectively. Adder 120 then combines all input signals and produces the left-channel output signal at terminal 44 and, similarly, adder 122 combines all input signals and provides the right-channel output at terminal 46. It is understood, of course, that the various sound position processors shown in FIG. 6 can assume any of the various embodiments described above.

While the embodiment shown in FIG. 6 comprising a so-called group positioner functions perfectly and, indeed, operates with high efficiency, it is nonetheless somewhat expensive because it has a large number of sound positioners, which comprise digital filters in some embodiments and can, thus, be quite expensive. On the other hand, only two adders are required and adders are relatively inexpensive compared to digital filters. Therefore, the present invention provides another embodiment, shown in FIG. 7, of a group positioner that is quite inexpensive relative to the embodiment to FIG. 6 because only two 3/9 o'clock transfer functions are required.

Figure 7:
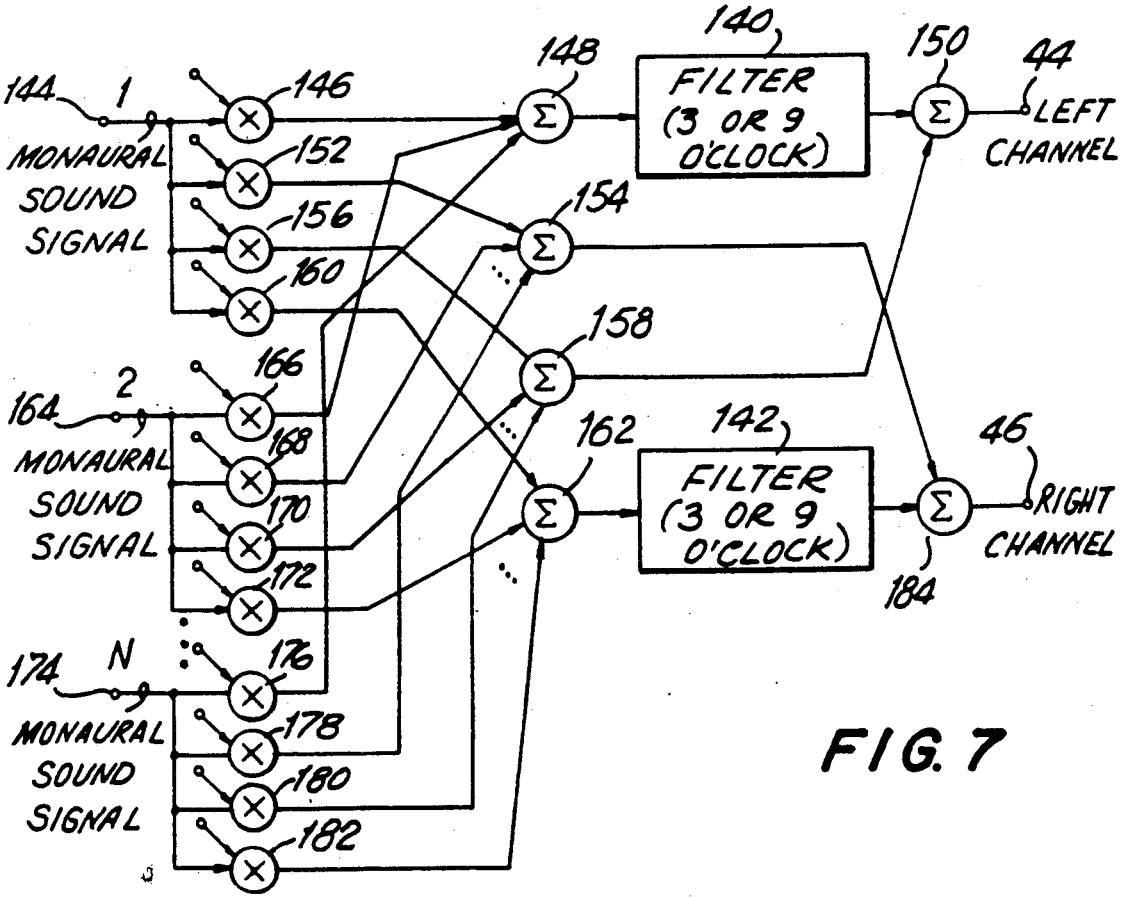
FIG. 7 is a block diagram showing a number of sound processors as in FIG. 5 connected together according to another embodiment of the present invention.

Turning then to FIG. 7, a multiple channel positioner is shown that employs only two 3/9 o'clock filters 140 and 142, but employs a number of adders and gain adjusters that are relatively inexpensive compared to the filters. More specifically, in the first channel, a monaural input signal is provided at input terminal 144 and is fed through a first gain adjuster 146 to a signal adder 148, whose output is the input to a first 3/9 o'clock filter 140. The output of filter 140 is fed to another signal adder 150. The monaural sound signal at input terminal 144 is also fed to a second gain adjuster 152 whose output is fed to another signal adder 154. The same input signal is also fed to a third gain adjuster 156 whose output is fed to adder 158, and to a fourth gain adjuster 160 that has an output fed to a fourth input adder 162. This arrangement is somewhat similar to the system shown in FIG. 5, for example. In fact, the embodiment of FIG. 7 can be seen as a specialized case of the embodiment of FIG. 5 in which a number of adders are provided ahead of the two 3/9 o'clock filters. The second monaural sound signal is fed in at input terminal 164 to gain adjuster 166, whose output is fed to adder 148, and the second monaural input signal is also fed to gain adjuster 168, whose output goes to adder 154, and to gain adjuster 170, whose output goes to adder 158, and to gain adjuster 172, whose output goes to adder 162. Any number of channel inputs can be provided and the last channel input in this example is represented as channel N input at terminal 174. The signal input at 174 is fed once again to four gain adjusters 176, 178, 180, and 182, whose outputs are fed, respectively, to adders 148, 154, 158, and 162. As indicated, the output of adder 148 is fed to 3/9 o'clock filter 140, whose output is fed to output signal adder 150, and the output of adder 154 is fed to an output signal adder 184, the output of adder 158 is also fed to output signal adder 150 and the output of adder 162 is fed to the second 3/9 o'clock filter 142, whose output is also fed to output signal adder 184. Accordingly, output signal adders 150 and 184 produce the left-channel signal at output terminal 44 and the right-channel signal at output terminal 46, respectively.

Comparing the embodiment of FIG. 7 with that of FIG. 6, it is easily seen that a cost savings in circuitry is achieved because only two filters are required regardless of the number of input channels, whereas in the embodiment of FIG. 6, at least one filter is required for each input channel.

The above description is given on a single preferred embodiment of the invention, but it will be apparent that many modifications and variations could be effected by one skilled in the art without departing from the spirit or scope of the novel concepts of the invention, which should be determined by the appended claims.

What is claimed is:

1. A processor for producing a sound image for reproduction over a pair of speakers in a video game system employing a game cartridge including video display data, audio data, and sound positioning information and an audio synthesizer producing an audio signal in accordance with the audio data from the game cartridge, the processor comprising:

means for receiving the audio signal produced by the synthesizer and producing at least two substantially identical output signals therefrom; and a plurality of phase shift and gain adjustment means, each receiving one of said identical output signals, for shifting the phase and adjusting the gain of said identical output signal by respective predetermined amounts and being responsive to said sound positioning information from said game cartridge and for producing first and second system output signals having predetermined phase shift and amplitude differential therebetween on a frequency dependent basis for discrete frequency bands over the audio spectrum, said first and second system output signals being fed to respective ones of the pair of speakers.

2. A processor for producing a sound image for reproduction over a pair of loudspeakers in a video game employing a game cartridge including video display data, audio data, and sound positioning information and an audio synthesizer for producing an audio signal from said audio data of said game cartridge, the processor comprising:

means for splitting said audio signal from said audio synthesizer into a plurality of identical monoaural audio signals;

filter means for imparting a phase shift and amplitude adjustment to one of said plurality of identical audio signals from said means for splitting on a frequency dependent basis for discrete frequency bands over substantially the audio spectrum and producing a filtered output signal a first plurality of signal level adjusters each receiving one of said plurality of identical monaural audio signals from said means for splitting for producing respective level adjusted output signals in response to receiving said sound positioning data derived from said game cartridge;

a second plurality of signal level adjusters each receiving said filtered output signal from said filter means for producing respective level adjusted filtered output signals in response to receiving said sound positioning information derived from said game cartridge; and first and second signal summing means each for summing respective level adjusted output signals and level adjusted filtered output signals from said first and second plurality of signal level adjusters, respectively, and each producing a respective summed system output signal therefrom fed to a respective one of the pair of loudspeakers.

3. A processor according to claim 2, wherein said filter means is a digital filter.

4. A processor according to claim 2, wherein said first plurality of signal level adjusters comprises two signal attenuators, each responsive to the sound positioning information from the game cartridge to selectively produce a maximum gain or a minimum gain.

5. A processor according to claim 2, wherein said second plurality of signal level adjusters comprises two signal attenuators, each responsive to the sound positioning information from the game cartridge to selectively produce a maximum gain or a minimum gain.

6. A processor for producing a sound image for reproduction over a pair of loudspeakers in a video game employing a game cartridge including video data, audio data, and sound positioning information and an audio synthesizer for producing an audio signal from said audio data of the game cartridge, the processor comprising:

a plurality of signal level adjusters, each receiving the audio signal from the audio synthesizer and each adjusting the signal level thereof in response to the sound positioning information from the game cartridge for producing a respective individual level adjusted output signal;

first and second phase shift and amplitude adjusting means each for receiving a level adjusted output signal from a selected one of said plurality of signal level adjusters for producing a respective first output signal having a predetermined phase shift and amplitude adjustment on a frequency dependent basis over substantially the audio frequency spectrum; and first and second signal summing means, each for receiving a respective first output signal from said first and second phase shift and amplitude adjusting means and each receiving a respective level adjusted output signal from signal level adjusters other than said selected ones for producing respective first and second summed system output signals fed to said pair of loudspeakers, respectively.

7. A processor according to claim 6, wherein each of said first and second phase adjusting means comprises a digital filter.

8. A processor according to claim 6, wherein each of said plurality of signal level adjuster means comprises an attenuator responsive to the sound positioning information from the game cartridge to selectively produce a maximum level signal or a minimum level signal.

9. A processor for producing a sound image for playback on a pair of loudspeakers in a video game employing a game cartridge having video data, audio data, and sound positioning information and an audio synthesizer producing a plurality of audio signals based on the audio data, the processor comprising:

a plurality of phase shift and amplitude adjustment means, each for receiving a respective one of the audio signals from the audio synthesizer, and each for dividing the audio signal and for selectively shifting the phase and adjusting the amplitude of at least one of the divided audio signals in response to the sound positioning information from the game cartridge and each of said plurality of phase shift and amplitude adjustment means for producing a pair of first and second output signals having a differential phase shift and amplitude adjustment therebetween on a frequency dependent basis; and first and second signal summing means, said first summing means for receiving a plurality of first output signals from each of said plurality of phase shift and amplitude adjustment means for each producing a first summed system output signal fed to one of the pair of loudspeakers and said second summing means for receiving a plurality of second output signals from each of said phase shift and amplitude adjustment means for producing a second summed system output signal fed to the other of the pair of loudspeakers.

10. A processor according to claim 9, wherein each of said phase shift and amplitude adjustment means comprises:

means for splitting the audio signal from the audio synthesizer into a plurality of identical audio output signals;

filter means for imparting a phase shift and amplitude adjustment to a selected one of said plurality of identical audio output signals on a frequency dependent basis over substantially the audio spectrum and producing a filtered output signal;

a first plurality of signal level adjusters each receiving one of said plurality of identical audio output signals from said means for splitting for producing respective level adjusted output signals in response to said sound positioning data from said game cartridge;

a second plurality of signal level adjusters each receiving said filtered output signal from said filter means for producing respective level adjusted filtered output signals in response to said sound positioning data from said game cartridge; and third and fourth signal summing means each for summing a respective level adjusted output signal from said first plurality of signal level adjusters and a respective level adjusted filtered output signal from said second plurality of signal level adjusters and each producing a respective summed output signal therefrom fed to a respective one of said first and second signal summing means.

11. A processor according to claim 10, wherein said first plurality of signal level adjusters comprises two signal attenuators, each responsive to the sound positioning information from the game cartridge to selectively produce a maximum gain or a minimum gain.

12. A processor according to claim 11, wherein said second plurality of signal level adjusters comprises two signal attenuators, each responsive to the sound positioning information from the game cartridge to selectively produce a maximum gain or a minimum gain.

13. A processor according to claim 9, wherein each of said phase shift and amplitude adjustment means comprises a plurality of signal level adjusters, each receiving one of said plurality of audio signals from the audio synthesizer and each adjusting the signal level thereof in response to the sound positioning data from the game cartridge and producing a respective level adjusted output signal;

first and second filter means each for receiving a level adjusted output signal from a selected one of said plurality of signal level adjusters and for producing a respective filtered, level adjusted output signal having a predetermined phase shift and amplitude adjustment on a frequency dependent basis over substantially the audio frequency spectrum; and third and fourth signal summing means, each for receiving a respective filtered, level adjusted output signal from said first and second phase adjusting means and each receiving a respective level adjusted output signal from signal level adjusters other than said selected ones and for producing respective first and second summed output signals fed to said first and second signal summing means, respectively.

14. A processor according to claim 13, wherein each of said plurality of signal level adjusters comprises an attenuator responsive to the sound positioning information from the game cartridge to selectively produce a maximum level signal or a minimum level signal.

15. A processor for producing a sound image for playback on a pair of loudspeakers in a video game employing a game cartridge having video data, audio data, and sound positioning information and an audio synthesizer producing a plurality of audio signals based on the audio data, the processor comprising:

a plurality of groups of four signal level adjusters, each signal level adjuster in each group receiving a respective one of the plurality of audio signals from the audio synthesizer and each level adjuster in each group adjusting the signal level thereof in response to the sound positioning information from the game cartridge for producing a respective level adjusted output signal;

first, second, third, and fourth signal summing means, each for receiving a signal from a respective level adjuster in each of said plurality of groups for producing respective summed output signals therefrom;

a first phase shift and amplitude adjusting means for receiving said summed signal from said first signal summing means and for producing a first phase shifted and amplitude adjusted output signal therefrom;

a second phase shift and amplitude adjusting means for receiving said summed signal from said fourth signal summing means and for producing a second phase shifted and amplitude adjusted output signal therefrom;

a fifth signal summing means for receiving said phase shifted and amplitude output signal from said first phase shift and amplitude adjusting means and a summed output signal from said third signal summing means and for producing a system output signal therefrom fed to one of the pair of loudspeakers; and a sixth signal summing means for receiving said phase shifted and amplitude adjusted signal from said second phase shift and amplitude adjusting means and a summed output signal from said second signal summing means and for producing a system output signal therefrom fed to the other of the pair of loudspeakers.

16. A processor according to claim 15, wherein each of said first and second phase shift and amplitude adjusting means comprises a digital filter.

17. A processor according to claim 15, wherein each of said plurality of signal level adjuster means comprises an attenuator responsive to the sound positioning information from the game cartridge to selectively produce a maximum level signal or a minimum level signal.

* * * * *